US006393246B2

(12) United States Patent
Tsujihara

(10) Patent No.: US 6,393,246 B2
(45) Date of Patent: May 21, 2002

(54) FIXING DEVICE AND METHOD HAVING A SHIELD MEMBER FOR CUTTING OFF AIR FLOWING THROUGH GAP AND IMAGE FORMING APPARATUS USING THE SAME FIXING DEVICE

(75) Inventor: Sotohiro Tsujihara, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/801,765

(22) Filed: Mar. 9, 2001

(30) Foreign Application Priority Data

Mar. 9, 2000 (JP) ..... 2000-064501
Feb. 27, 2001 (JP) ..... 2001-051421

(51) Int. Cl.[7] ..... G03G 15/20
(52) U.S. Cl. ..... 399/322; 399/323
(58) Field of Search ..... 399/322, 323

(56) References Cited

U.S. PATENT DOCUMENTS 3,955,813 A * 5/1976 Edwards ..... 399/323 X

FOREIGN PATENT DOCUMENTS

| | | | |
|---|---|---|---|
| JP | 3-101780 | * | 4/1991 |
| JP | 4-51262 | * | 2/1992 |
| JP | 5-27532 | * | 2/1993 |
| JP | 5-173440 | | 7/1993 |
| JP | 5-289570 | | 11/1993 |
| JP | 9-274421 | | 10/1997 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

A fixing device and method for fixing a toner image on a sheet in an image forming apparatus, includes a frame, a fusing roller rotatably provided in the frame, a pressure roller rotatably provided in the frame and configured to press against the fusing roller, a separating member configured to separate the sheet passed between the fusing roller and the pressure roller from the fusing roller, a sheet guide member configured to guide the sheet separated by the separating member and rotatably supported by the frame, and a shield member configured to prevent air from flowing from a space between the frame and the sheet guide member at a position where the sheet guide member is supported by the frame.

20 Claims, 9 Drawing Sheets

FIXING DEVICE AND METHOD HAVING A SHIELD MEMBER FOR CUTTING OFF AIR FLOWING THROUGH GAP AND IMAGE FORMING APPARATUS USING THE SAME FIXING DEVICE

CROSS-REFERENCE TO RELATED APPLICATIONS

The present application claims priority to Japanese Patent Application No. 2000-064501, filed in the Japanese Patent Office on Mar. 9, 2000, and Japanese Patent Application No. 2001-51421, filed in the Japanese Patent Office on Feb. 27, 2001. The contents of those applications are incorporated herein by reference in their entirety.

BACKGROUND OF THE INVENTION

1. Field of the Invention

The present invention relates to an image forming apparatus such as a copying machine, a printer, a facsimile and similar image forming apparatuses, and more particularly to a fixing device for an image forming apparatus.

2. Discussion of the Background

An image forming apparatus, for example, a copying machine, a printer and a facsimile, includes an image bearing member. An electrostatic latent image corresponding to image information is formed on the surface of the image bearing member and is visualized with toner.

A toner image is transferred to a sheet, and the toner image on the sheet is fixed thereon by heat and pressure in a fixing device.

For example, a fixing device employing a heat roller method includes a fusing roller and a pressure roller. The fusing roller and the pressure roller contact each other across a sheet conveying path. A nip part, i.e., a contact part, is formed between the fusing roller and the pressure roller. When the sheet passes through the nip part, a toner image on the sheet is fixed thereon by applying heat and pressure to the toner image.

In the above-described fixing device, the fusing roller is arranged at a position where the fusing roller directly contacts a toner image on a sheet. Therefore, fused toner on a sheet is likely to adhere to the circumferential surface of the fusing roller.

When toner does not completely permeate a sheet, the sheet may cling to the circumferential surface of the fusing roller together with the toner due to the viscosity of the toner. When the sheet clings to the fusing roller, the sheet is conveyed along the curvature of the fusing roller, thereby deviating the sheet from a sheet conveying path. This type of sheet jam results in a sheet staying in the fixing device.

The fixing device further includes a separation pick in the vicinity of the fusing roller so as to separate a sheet moving along the curvature of the fusing roller from the fusing roller. The separation pick cooperates with a sheet guide member arranged opposite to the separation pick and directs the sheet separated from the circumferential surface of the fusing roller to the sheet conveying path.

Because the separation pick has a sharp tip that abuts the circumferential surface of the fusing roller, there is no gap for a sheet to go into between the separation pick and the fusing roller. Hence, the sheet is properly separated from the fusing roller by the separation pick.

However, because the tip of the separation pick is constantly in contact with the circumferential surface of the fusing roller, over the course of time, the tip of the separation pick may be worn, and toner adhered to the surface of the fusing roller may be collected around the tip of the separation pick. As a result, the tip of the separation pick may be separated from the circumferential surface of the fusing roller, thereby causing a sheet to go into a gap formed between the separation pick and the fusing roller. Consequently, a sheet is likely to be jammed between the separation pick and the fusing roller.

A background image forming apparatus has a space around a sheet conveying path in a fixing device which can be opened to remove jammed sheets.

For example, Japanese Laid-open Patent Publication No. 9-274421 describes an image forming apparatus including a fixing device wherein the fixing device is pulled out to outside of a housing of the image forming apparatus by opening an opening/closing door formed as a part of the housing of the image forming apparatus so as to remove jammed sheets from the fixing device.

Japanese Laid-open Patent Publication No. 5-289570 describes an image forming apparatus including a fixing device wherein the fixing device includes an upper unit and a lower unit. In that image forming apparatus, a space around a sheet conveying path can be opened for removing jammed sheets by rotating the upper unit having an upper fixing roller away from the lower unit.

In a fixing device, steam is generated from a sheet because water included in the sheet evaporates under heat applied by a fusing roller. When the steam leaks out from the fixing device, condensation of the steam remaining in an image forming apparatus may occur.

Particularly, when the steam remaining in the image forming apparatus is cooled, condensation may occur in the image forming apparatus and water droplet may attach to a surface of an image bearing member. The water droplet on the surface of the image bearing member typically causes the photosensitive property of the image bearing member to change or a toner image on the surface of the image bearing member to spread. These result in deterioration of image quality.

SUMMARY OF THE INVENTION

According to one aspect of the present invention, a fixing device for fixing a toner image on a sheet in an image forming apparatus, includes a frame, a fusing roller rotatably provided in the frame, a pressure roller rotatably provided in the frame and configured to press against the fusing roller, a separating member configured to separate the sheet passed between the fusing roller and the pressure roller from the fusing roller, a sheet guide member configured to guide the sheet separated by the separating member and rotatably supported by the frame, and a shield member configured to prevent air from flowing from a space between the frame and the sheet guide member at a position where the sheet guide member is supported by the frame.

According to another aspect of the present invention, a method of preventing air from flowing out from a fixing device in an image forming apparatus, includes accommodating a fusing roller and a pressure roller in a frame of the fixing device, providing a separating member configured to separate a sheet passed between the fusing roller and the pressure roller from the fusing roller, and a sheet guide member configured to guide the sheet separated by the separating member, the sheet guide member being rotatably supported by the frame, and providing a shield member configured to prevent air from flowing from a space between the frame and the sheet guide member at a position where the sheet guide member is supported by the frame.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
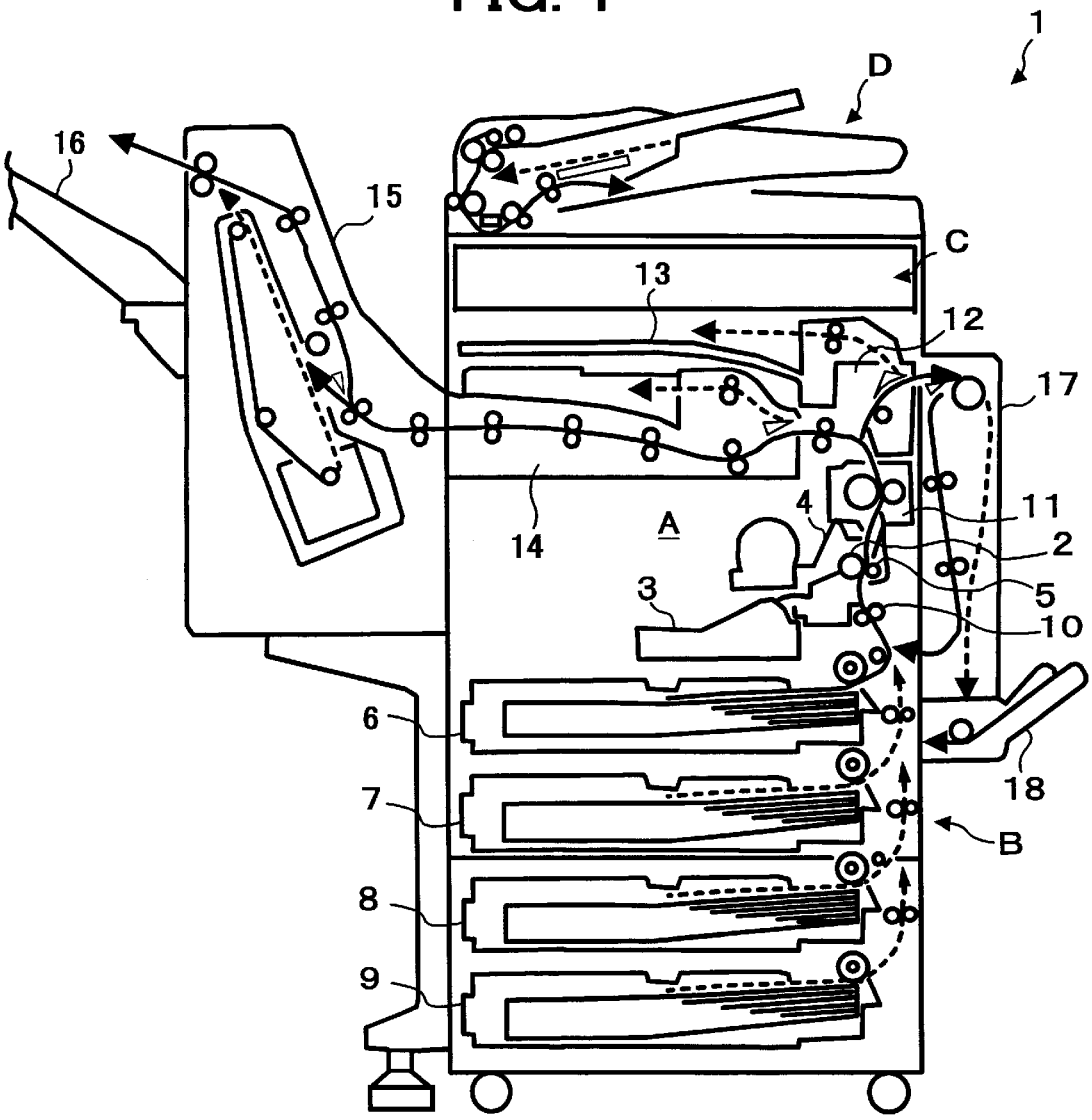
FIG. 1 is a schematic view of a copying machine including a fixing device according to one embodiment of the present invention.

Preferred embodiments of the present invention are described in detail referring to the drawings, wherein like reference numerals designate identical or corresponding parts throughout the several views.

FIG. 1 is a schematic view illustrating a copying machine as an image forming apparatus including a fixing device according to an embodiment of the present invention.

Referring to FIG. 1, a copying machine 1 includes an image forming unit (A) arranged at a center part of the copying machine 1 in a vertical direction, a sheet feeding unit (B) arranged below the image forming unit (A), an image scanning unit (C) and an auto document feeder (D) both of which are arranged above the image forming unit (A).

The image forming unit (A) includes a drum-shaped photoreceptor 2 serving as an image bearing member.

Arranged around the photoreceptor 2 are a charging device (not shown), an image writing device 3, a developing device 4, a transfer device 5, a cleaning device (not shown), and a discharging device (not shown) in the order of the rotational direction of the photoreceptor 2.

In the image forming unit (A), the surface of the photoreceptor 2 uniformly charged by the charging device is exposed to a light-modulated laser beam emitted from the image writing device 3. Thereby, an electrostatic latent image is formed on the surface of the photoreceptor 2. The electrostatic latent image is developed with toner supplied from the developing device 4 and a toner image is formed on the surface of the photoreceptor 2. The toner image on the photoreceptor 2 is transferred to a sheet fed from the sheet feeding unit (B) by the transfer device 5.

The sheet feeding unit (B) includes a plurality of sheet feeding cassettes 6, 7, 8, 9. When one of the sheet feeding cassettes 6, 7, 8, 9 is selected, a top sheet of the sheets stacked in the selected sheet feeding cassette is fed out. Then, a pair of registration rollers 10 rotates to feed the sheet fed from the sheet feeding cassette in synchronization with the rotation of the photoreceptor 2 at a timing such that a leading edge of the toner image formed on the photoreceptor 2 is aligned with a leading edge of the sheet. Subsequently, the toner image formed on the photoreceptor 2 is transferred to the sheet by the transfer device 5.

After transferring the toner image to the sheet, the cleaning device removes residual toner remaining on the photoreceptor 2 from the surface of the photoreceptor 2. Subsequently, the surface of the photoreceptor 2 is exposed to light to remove residual charge by the discharging device and is then prepared for a next image forming operation.

The sheet with the transferred toner image is further conveyed to the fixing device 11. The transferred toner image is fixed to the sheet under heat and pressure in the fixing device 11.

Subsequently, when an image is formed on one side of a sheet, i.e., one-sided copying, the sheet with the fixed toner image is directed to one of two sheet discharging paths. In a first sheet discharging path, a sheet is discharged to a sheet discharging tray 13 arranged in the image forming unit (A) via a sheet discharging device 12. In a second sheet discharging path, a sheet is conveyed to a sheet post-processing device 15, i.e., a finisher, via a sheet relay unit 14, and is then discharged to a sheet discharging tray 16 for the sheet post-processing device 15. In the sheet post-processing device 15, sheet sorting, collating and stapling operations are performed.

When an image is formed on two sides of a sheet, i.e., two-sided copying, a sheet with a fixed toner image on one side thereof is directed to a reverse conveying device 17. The sheet passing through the reverse conveying device 17 is returned to the registration rollers 10. Then, a toner image on the photoreceptor 2 is transferred to another side of the sheet and fixed thereon. The sheet with the fixed toner images on two sides thereof is discharged to the sheet discharging tray 13 or the sheet discharging tray 16 via the above-described first or second sheet discharging path.

On the right-hand side wall of the image forming unit (A) in FIG. 1, a manual sheet feeding tray 18 is provided to feed an irregular size or material sheet toward the registration rollers 10.

In the copying machine 1 according to the embodiment of the present invention, the sheet conveying path in the sheet feeding unit (B) and the image forming unit (A) is formed in the vertical direction except the above-described first and second sheet discharging paths. Owing to the vertical sheet conveying path in the copying machine 1, the installation space of the copying machine 1 can be reduced.

A scanner (not shown) is installed in the image scanning unit (C) to scan an original document put on an original document setting table (not shown). The auto document feeder (D) automatically feeds original documents to be scanned successively.

Figure 2:
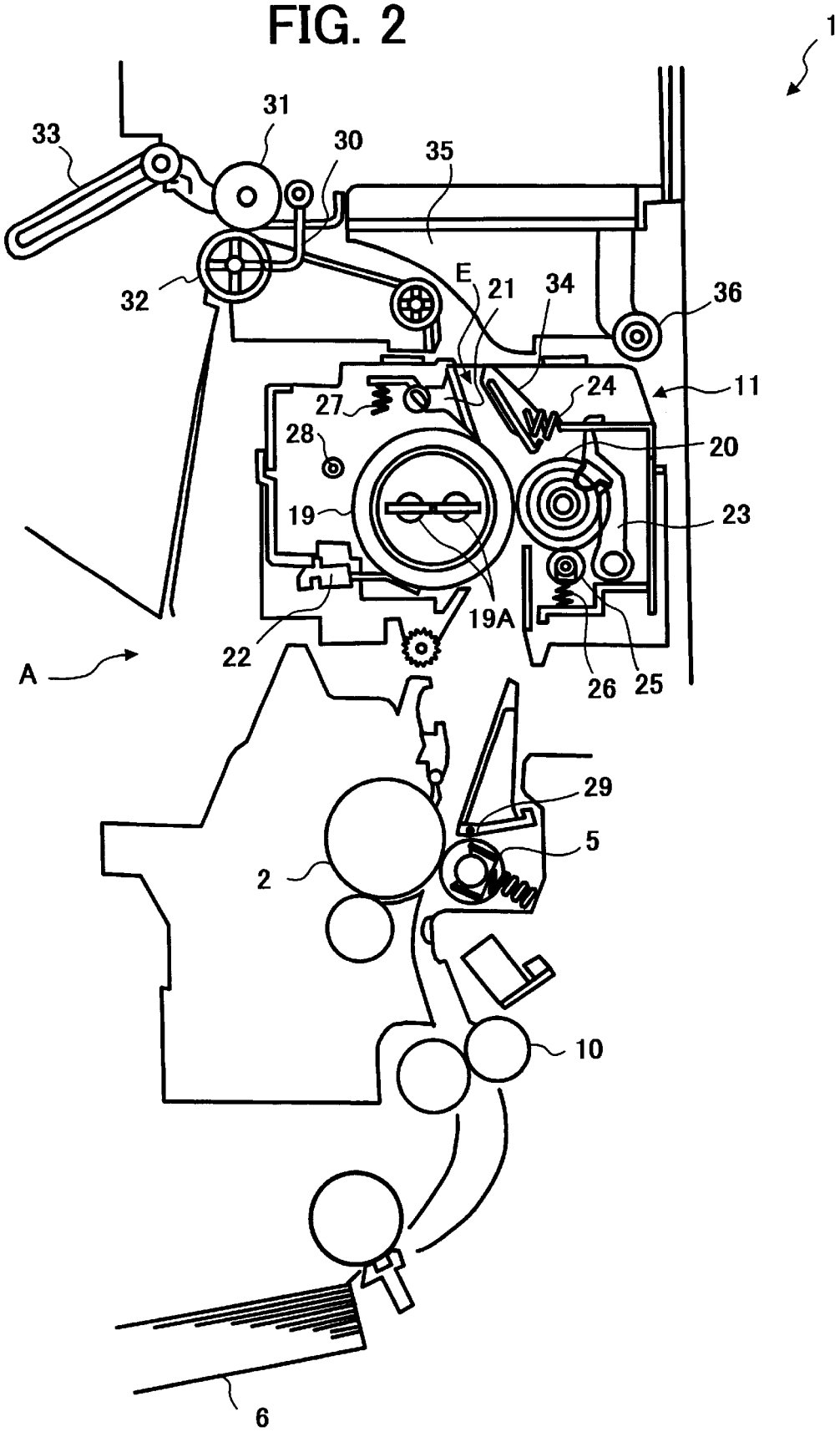
FIG. 2 is a schematic view of a configuration of the fixing device of the copying machine shown in FIG. 1.

FIG. 2 is a schematic view illustrating a configuration of the fixing device 11. Referring to FIG. 2, the fixing device 11 according to the embodiment of the present invention employs a heat roller method and includes a fusing roller 19, a pressure roller 20 and separation picks 21 serving as a separating member for separating a sheet passed between the fusing roller 19 and the pressure roller 20 from the fusing roller 19.

The fusing roller 19 includes two heaters 19A therein. A thermistor 22 contacts the surface of the fusing roller 19 to detect a temperature of the surface of the fusing roller 19.

The pressure roller 20 is pressed against the fusing roller 19 by a pressure lever 23 and a pressure spring 24. A cleaning roller 25 is pressed against the pressure roller 20 by a spring 26.

Figure 4:
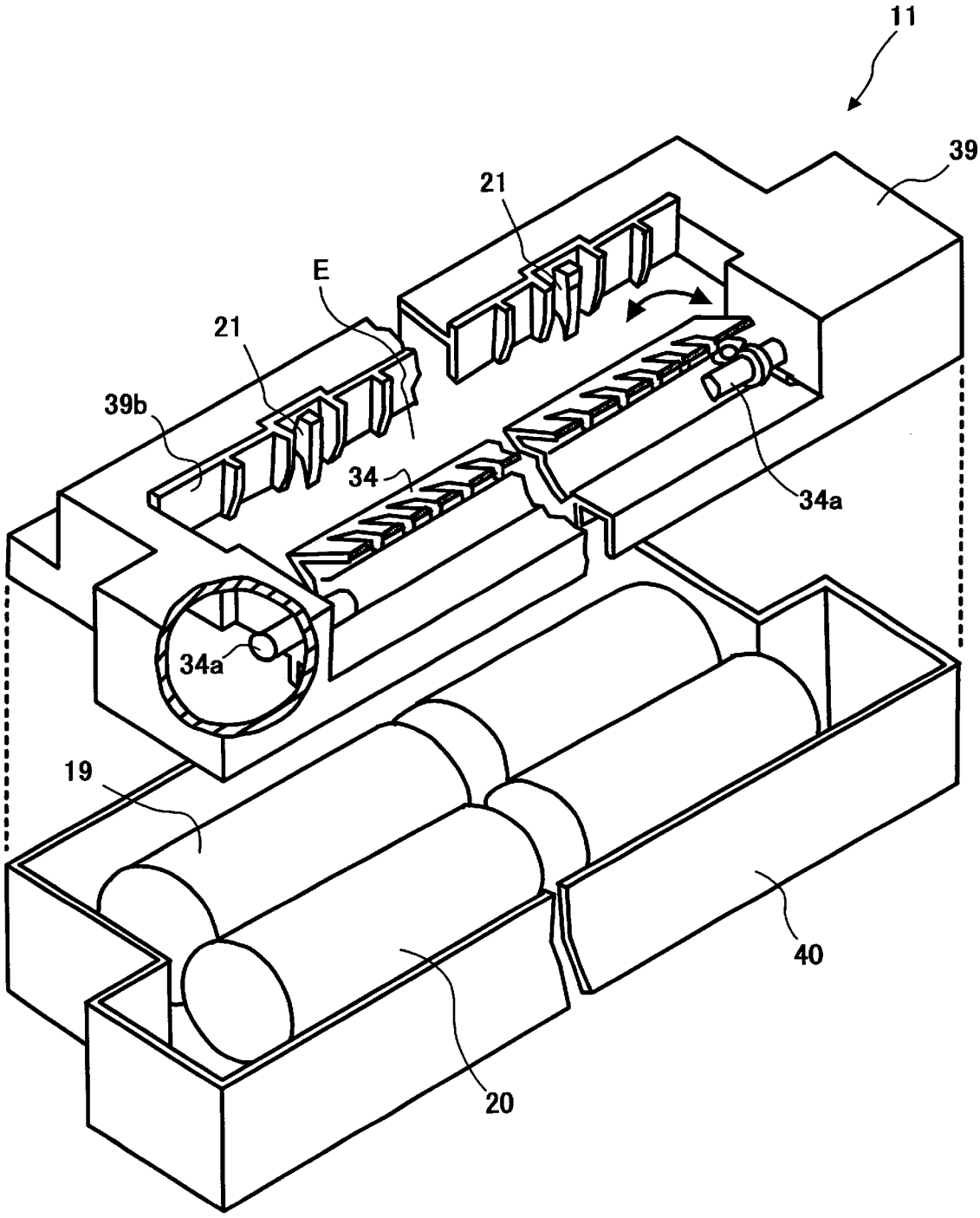
FIG. 4 is an exploded perspective view of the fixing device shown in FIG. 1.

As illustrated in FIG. 4, a plurality of separation picks 21, for example, five separation picks 21 in this embodiment, are arranged in the axial direction of the fusing roller 19 at predetermined intervals. The separation picks 21 are biased by a spring 27 such that the tips of the separation picks 21 abut the surface of the fusing roller 19 at a predetermined pressure.

Referring to FIG. 2, the image forming unit (A) of the copying machine 1 further includes a temperature fuse 28, a discharging needle bar 29, a sheet discharging sensor filler 30, a sheet discharging driving roller 31, a sheet discharging driven roller 32 and a full stacked sheets detecting sensor filler 33.

At a sheet conveying outlet (E) of the fixing device 11, a sheet guide member 34 is arranged opposite to the separation pick 21 to guide a sheet passing through a nip part between the fusing roller 19 and the pressure roller 20. The sheet guide member 34 is arranged at a position where the sheet guide member 34 guides a non-image side of a sheet in a case of one-sided copying mode.

Figure 3:
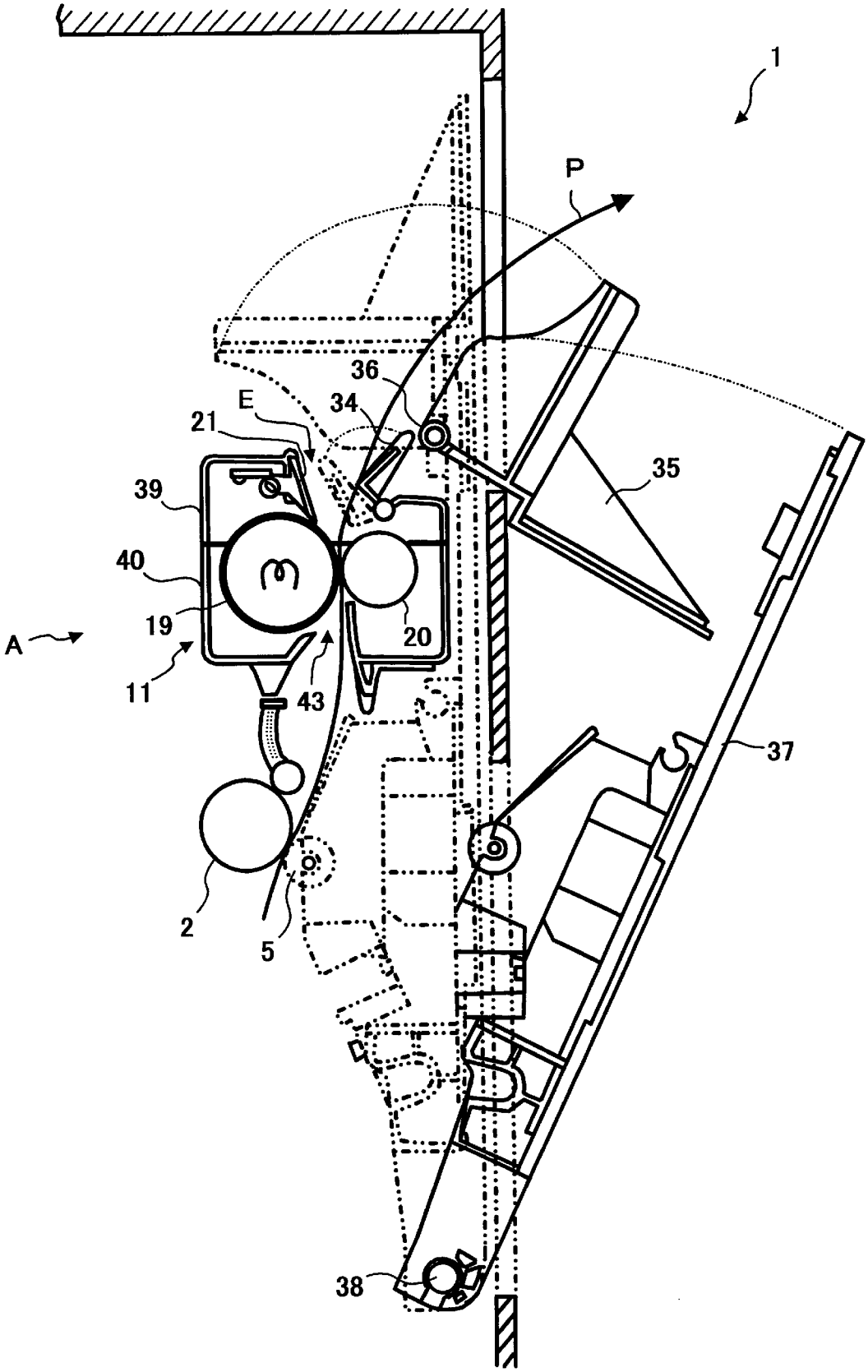
FIG. 3 is a schematic view of a right cover and a sheet conveying guide member of the copying machine shown in FIG. 1.

The sheet guide member 34 rotates between two positions, a closed position where the sheet guide member 34 guides a sheet toward the outside of the fixing device 11, i.e., a sheet guide position, and an open position where the sheet guide member 34 is opened for removing jammed sheets, i.e., a sheet jam removing position. Referring to FIG. 3, the sheet guide member 34 situated at the close position is indicated by a two-dots-and-dash line, and the sheet guide member 34 situated at the open position is indicated by a solid line.

Referring to FIGS. 2 and 3, in vicinity of the sheet guide member 34, a sheet conveying guide member 35 is provided downstream of the sheet conveying outlet (E) of the fixing device 11 such that the sheet conveying guide member 35 is rotated around a shaft 36 in a direction away from the image forming unit (A).

Referring to FIG. 3, a right cover 37 of the copying machine 1 is rotatably provided around a shaft 38. By opening the right cover 37 in a direction away from the image forming unit (A), a large space around the above-described vertical sheet conveying path is opened. The opened right cover 37 and the opened sheet conveying guide member 35 are indicated by a solid line in FIG. 3.

As illustrated in FIGS. 3 and 4, the fixing device 11 includes two divided frames, i.e., an upper frame 39 having the sheet conveying outlet (E), and a lower frame 40. The main elements of the fixing device 11, for example, the fusing roller 19 and the pressure roller 20, are accommodated in a space of the lower frame 40.

Referring to FIG. 4, the sheet guide member 34 includes a rotation shaft 34*a* that extends in the axial direction of the fusing roller 19 and is supported by the upper frame 39. The sheet guide member 34 is rotatably provided around the rotation shaft 34*a*.

Figure 5:
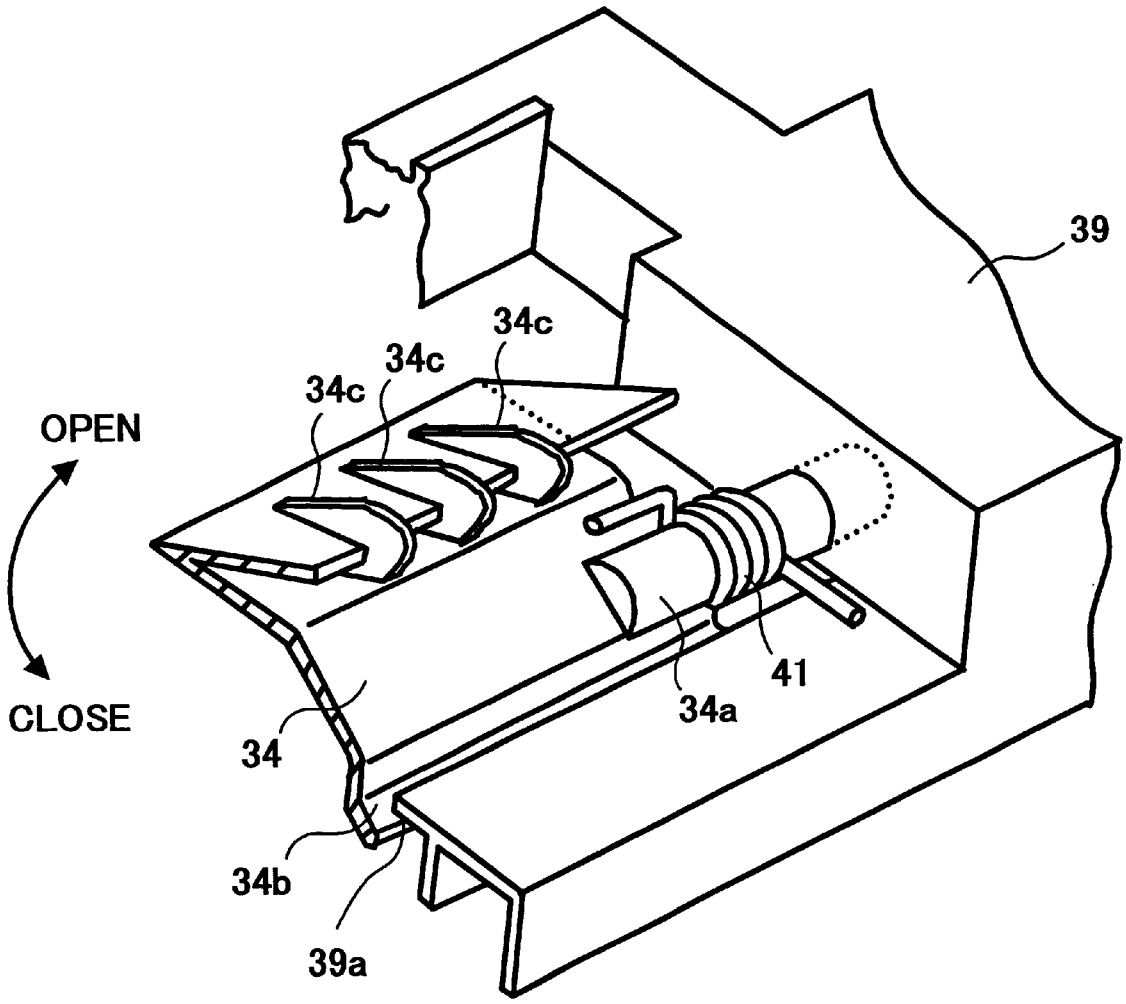
FIG. 5 is a perspective view of an upper frame and a sheet guide member of the fixing device shown in FIG. 4.

As illustrated in FIG. 5, a torsion coil spring 41 serving as a biasing member is attached to the rotation shaft 34*a* to bias the sheet guide member 34 toward the separation picks 21.

Figure 9:
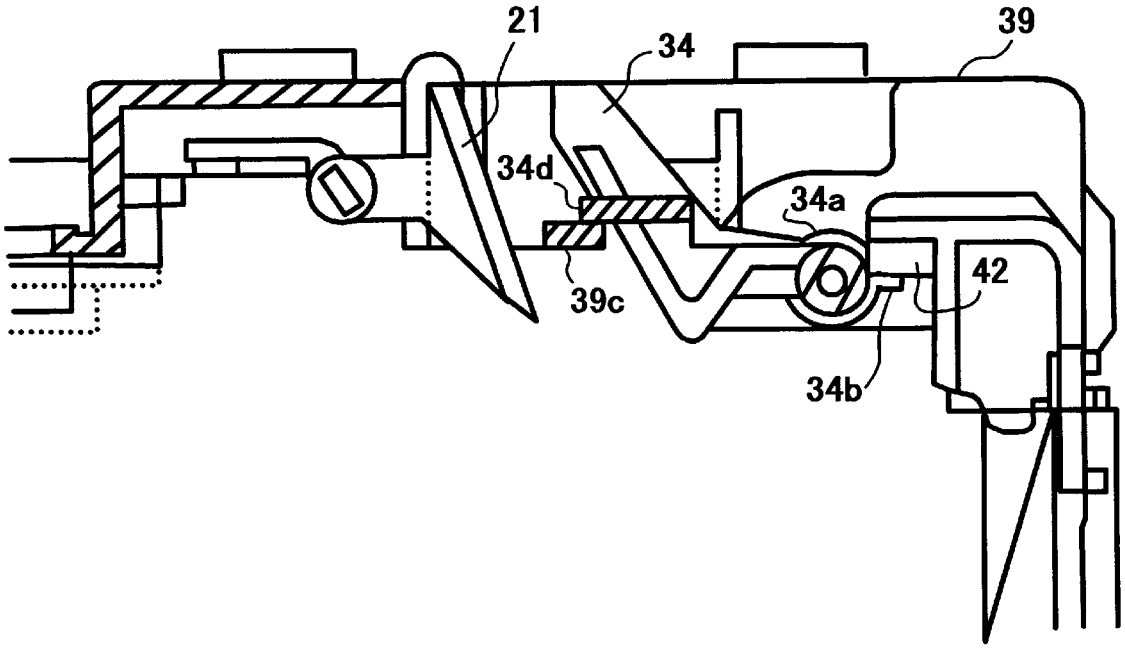
FIG. 9 is a schematic view of the fixing device shown in FIG. 1 when a sheet guide position of the sheet guide member is determined.

As illustrated in FIG. 9, the sheet guide member 34 and the upper frame 39 include contact parts 34*d*, 39*c*, respectively, which overlap each other in a vertical direction. The sheet guide position of the sheet guide member 34 is determined when the contact parts 34*d*, 39*c* contact each other.

Figure 6A:
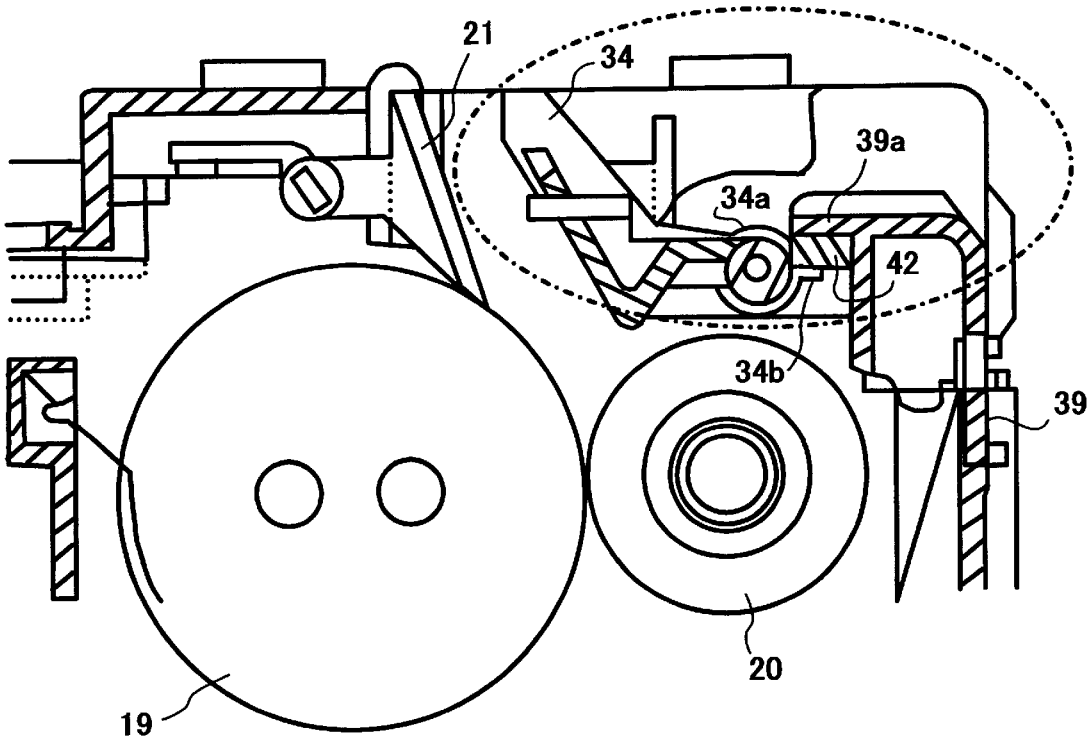
FIG. 6A is a schematic view of a projecting part of a sheet guide member, a tip portion of an upper frame and a shield member arranged in the fixing device shown in FIG. 5.
Figure 6B:
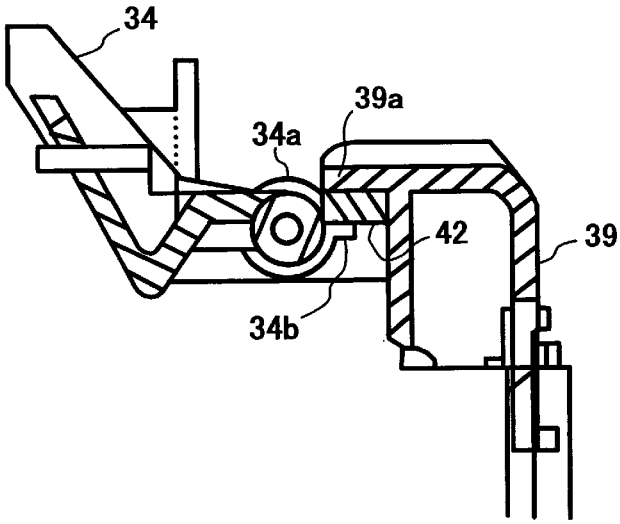
FIG. 6B is an enlarged view of the projecting part of the sheet guide member, the tip portion of the upper frame, and the shield member encircled by a one-dot-and-dash line in FIG. 6A.
Figure 7:
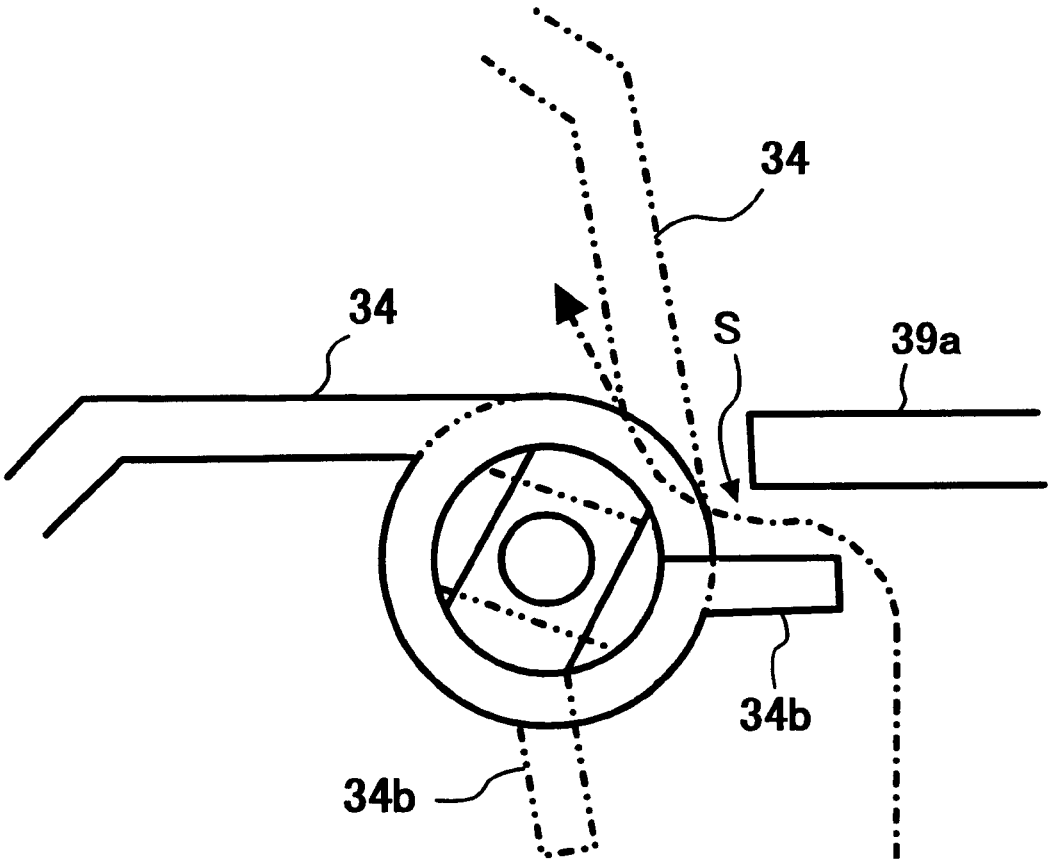
FIG. 7 is a schematic view of a gap formed between the tip portion of the upper frame and a circumferential surface of a rotation shaft of the sheet guide member shown in FIGS. 6A and 6B.

The sheet guide member 34 is rotatably supported by the rotation shaft 34*a* that is supported by the upper frame 39. As illustrated in FIGS. 6A, 6B and 7, the sheet guide member 34 includes a projecting part 34*b* that projects diametrically from the circumferential surface of the rotation shaft 34*a*. When the sheet guide member 34 is closed at the sheet guide position with the contact part 34*d* of the sheet guide member 34 and the contact part 39*c* of the upper frame 39 contacted each other, the projecting part 34*b* of the sheet guide member 34 faces a tip portion 39*a* of the upper frame 39.

As illustrated in FIG. 7, a gap (S) is formed between the tip portion 39*a* of the upper frame 39 and the circumferential surface of the rotation shaft 34*a* to allow the sheet guide member 34 to rotate. By forming the gap (S), the rotation shaft 34*a* of the sheet guide member 34 rotates without interfering with the tip portion 39*a* of the upper frame 39.

Moreover, as illustrated in FIGS. 6A and 6B, the gap (S) is filled with a shield member 42 to cut off air including steam flowing between the space of the frame accommodating the fusing roller 19 and the pressure roller 20 and an outside of the frame of the fixing device 11 through the gap (S).

The shield member 42 includes an elastic member having a thickness greater than the width of the gap (S) to some extent. The shield member 42 is integrally attached to the tip portion 39*a* of the upper frame 39.

When the sheet guide member 34 is closed at the sheet guide position, the shield member 42 is in intimate contact with the projecting part 34*b* of the sheet guide member 34 and the tip portion 39*a* of the upper frame 39 by being sandwiched between the projecting part 34*b* and the tip portion 39*a*. Even if the projecting part 34*b* of the sheet guide member 34 shifts in a contacting/separating direction from the tip portion 39*a* of the upper frame 39 due to thermal expansion of the sheet guide member 34, because the shield member 42 is deformable, the shield member 42 remains in intimate contact with the projecting part 34*b* and the tip portion 39*a*.

Because the shield member 42 is sandwiched between the projecting part 34*b* and the tip portion 39*a* which are situated above the fusing roller 19 and the pressure roller 20 when the sheet guide member 34 is closed at the sheet guide position, the shield member 42 is arranged at an upper part of the fixing device 11. Owing to this arrangement of the shield member 42, even though a part of steam generated in the fixing device 11 moves toward the gap (S) by an upward draft of air produced in the fixing device 11, the steam is cut off by the shield member 42 positioned between the projecting part 34*b* and the tip portion 39*a*.

For the elastic member of the shield member 42, a foaming material or a nonwoven fabric material, for example, can be employed. When the elastic member of the shield member 42 is a foaming material, the foaming material has a closed-cell structure.

In the case of a foaming material having closed-cells, instead of connecting cells, even though steam generated in the fixing device 11 attaches to one side surface of the foaming material, the steam does not permeate into the foaming material. Owing to the shield member 42 of the foaming material having closed-cells, the steam does not flow through the gap (S). Thus, the steam does not leak from the fixing device 11.

In the case of a nonwoven fabric material, even if steam generated in the fixing device 11 permeates into the nonwoven fabric material, the steam does not permeate through the nonwoven fabric material. Similarly, as for the foaming material having closed-cells, the steam generated in the fixing device 11 does not leak out from the fixing device 11.

As illustrated in FIG. 5, a sheet guide surface of the sheet guide member 34 is formed with a plurality of ribs 34*c* extending in the sheet conveying direction. Owing to the ribs 34*c*, the friction between a sheet and the sheet guide surface of the sheet guide member 34 can be reduced, so that the sheet can be conveyed smoothly.

An operator of the copying machine 1 can easily rotate the sheet guide member 34 with her hands to remove jammed sheets. When the operator touches the sheet guide surface of the sheet guide member 34 heated to a relatively high temperature, she may think that she can get burned on her hands. However, because the ribs 34*c* in a fin shape dissipate heat, the sheet guide surface of the sheet guide member 34 does not heat up the ribs 34*c*. Thus, the ribs 34*c* permit the operator to touch the ribs 34*c* and rotate the sheet guide member 34 without worrying a burn on her hands.

In the fixing device 11 with the above-described configuration, as illustrated in FIG. 3, a sheet (P) to which a toner image is transferred in the image forming unit (A) is conveyed to an inside of the fixing device 11 through a sheet conveying inlet 43 at the lower frame 40 of the fixing device 11. Subsequently, the sheet (P) passes through a nip part between the fusing roller 19 and the pressure roller 20, and the toner image is fixed to the sheet (P) under heat and pressure.

The sheet (P) with a fixed toner image is separated from the surface of the fusing roller 19 by the curvature of the fusing roller 19. Subsequently, the sheet (P) is discharged from the fixing device 11 through the sheet conveying outlet (E) formed between the upper frame 39 and the sheet guide member 34.

Depending on kinds of the sheet (P), a sheet conveying condition of the sheet (P) changes. For example, when the sheet (P) is a thin paper, a tip portion of the sheet (P) is discharged along a sheet conveying guide 39*b*, as illustrated in FIG. 4, formed by a part of the upper frame 39 at a toner image side of the sheet (P). Alternatively, when the sheet (P) is a thick paper having high flexural rigidity, a tip portion of the sheet (P) is discharged along the sheet guide member 34.

Figure 8A:
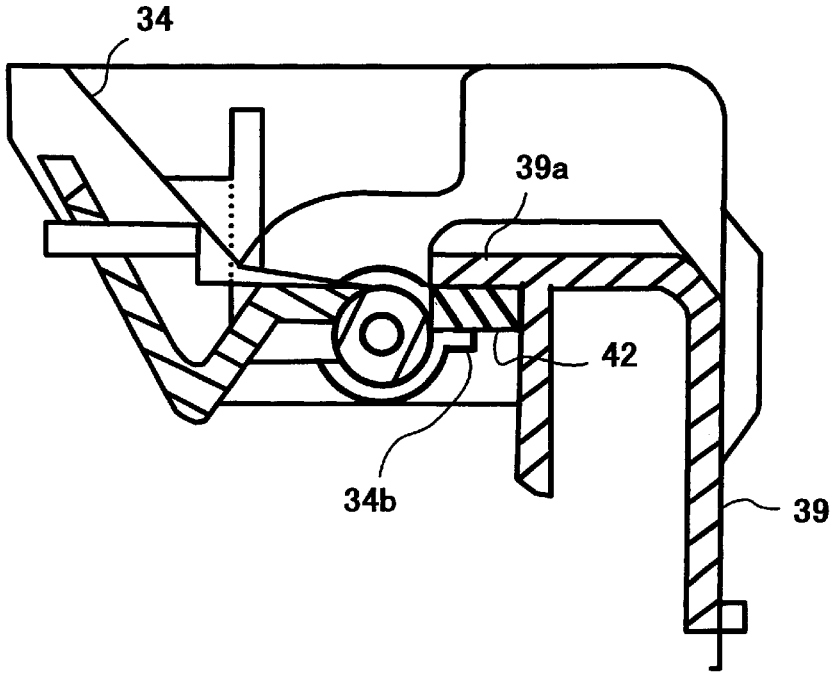
FIG. 8A is a schematic view of the sheet guide member and the upper frame shown in FIGS. 6A and 6B when the sheet guide member is situated at a closed position.

Although the sheet guide member 34 is rotatably supported by the upper frame 39, when the sheet (P) is discharged from the fixing device 11 along the sheet guide member 34, the sheet guide member 34 is not rotated by pushing force of the sheet (P) in a usual sheet conveyance. Therefore, the sheet guide member 34 guides the sheet (P) properly. FIG. 8A illustrates the sheet guide member 34 at the sheet guide position, i.e., the closed position, wherein the sheet guide member 34 guides the sheet (P) properly.

When the sheet (P) is a thin paper or the sheet (P) has a tip portion with high toner adhesion due to many toner images formed at the tip portion thereof, the sheet (P) does not separate from the fusing roller 19 only by its curvature. In this condition, the sheet (P) is conveyed along the curvature of the fusing roller 19, and then the separation picks 21 abutting the surface of the fusing roller 19 separate the sheet (P) from the fusing roller 19.

However, when the tip of the separation pick 21 is worn or toner adhered to the surface of the fusing roller 19 is collected around the tip of the separation pick 21, the tip of the separation pick 21 becomes separated from the surface of the fusing roller 19. Thereby, the tip portion of the sheet (P) is likely to go into a gap formed between the separation pick 21 and the fusing roller 19. As a result, the sheet (P) is likely to be jammed between the separation pick 21 and the fusing roller 19.

In a continuous copying mode, when a sheet jam occurs downstream of the fixing device 11 in the sheet conveying direction, a subsequent sheet P may catch up with a previous sheet (P) at around the sheet conveying outlet (E) of the fixing device 11.

Because it takes a certain time to stop the copying machine 1 when a sheet jam occurs, the sheet (P) continues to be fed into the fixing device 11 even after the sheet jam. As a result, the sheet (P) may be jammed like a bellows and stay at the sheet conveying outlet (E).

In the above-described sheet jam condition, the sheet (P) jammed like a bellows is pressed over a substantially full face of the sheet guide surface of the sheet guide member 34 at the sheet conveying outlet (E). The pushing force of the sheet (P) thus jammed against the sheet guide member 34 becomes greater than a force exerted on the sheet guide member 34 when the sheet (P) is guided by the sheet guide member 34 in the usual condition.

When the sheet guide member 34 rotates toward the open position by the pushing force of the sheet (P), a space around the sheet conveying outlet (E) increases. As a result, the jammed sheet (P) escapes to the increased space. Compared with a copying machine wherein the sheet guide member is fixed, i.e., not rotatable, the jammed sheet (P) stops in a condition in which it is easy to remove from the fixing device 11 in the copying machine 1 wherein the sheet guide member 34 is rotatable.

Owing to the above-described increased space provided by rotating the sheet guide member 34, the jammed sheet (P) escapes into the increased space, and thus an occurrence of a complicated sheet jam can be reduced.

When an operator removes a jammed sheet from the fixing device 11, the operator rotates the right cover 37 around the shaft 38 in the direction away from the case of the copying machine 1 first, and then the sheet conveying guide member 35 is opened. Subsequently, the operator rotates the sheet guide member 34 that is half-opened by the pushing force of the jammed sheet to the open position so as to provide an operation space for removing the jammed sheet. Finally, the operator reaches into the space to remove the jammed sheet.

The positions of the projecting part 34*b* of the sheet guide member 34 and the tip portion 39*a* of the upper frame 39 varies between when the sheet guide member 34 guides the sheet at the closed position, i.e., the sheet guide position, and when the sheet guide member 34 is opened for removing the jammed sheet at the open position, i.e., the sheet jam removing position.

Figure 8B:
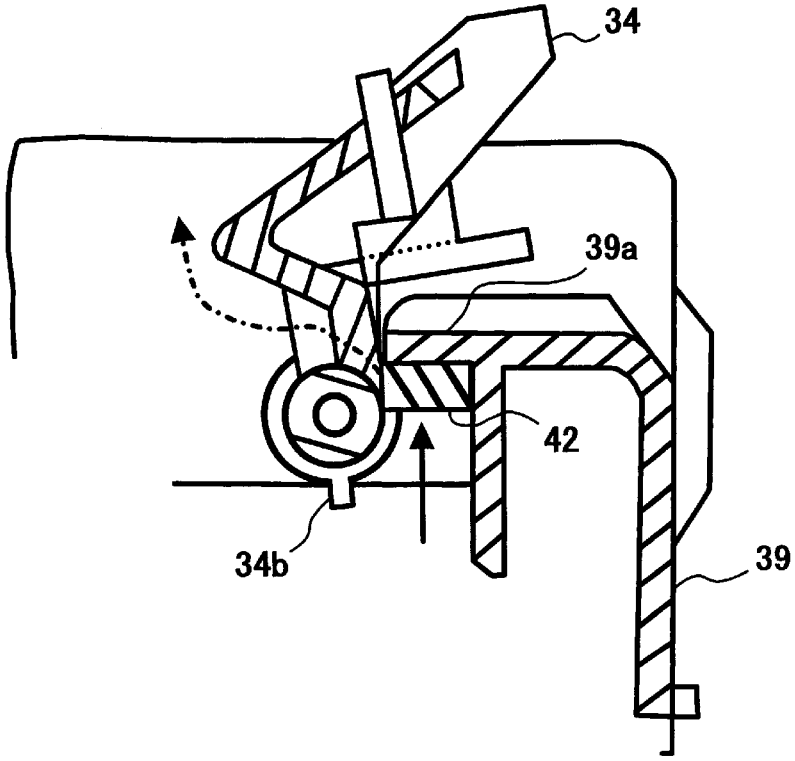
FIG. 8B is a schematic view of the sheet guide member and the upper frame shown in FIGS. 6A and 6B when the sheet guide member is situated at an open position.

FIG. 8A illustrates the sheet guide member 34 and the upper frame 39 when the projecting part 34*b* of the sheet guide member 34 and the tip portion 39*a* of the upper frame 39 face each other across the shield member 42, i.e., when the sheet guide member 34 is situated at the closed position. FIG. 8B illustrates the sheet guide member 34 and the upper frame 39 when the projecting part 34*b* is separated from the tip portion 39*a*, i.e., the sheet guide member 34 is situated at the open position.

As illustrated in FIGS. 8A and 8B, irrespective of the positions of the projecting part 34*b* and the tip portion 39*a*, the gap (S) formed between the tip portion 39*a* and the circumferential surface of the rotation shaft 34*a* of the sheet guide member 34 is filled with the shield member 42. Thus, steam generated in the fixing device 11 does not leak out from the fixing device 11.

Referring to FIG. 8B, a flowing direction of the steam generated in the fixing device 11 is indicated by a solid line, and a flowing direction of the steam generated in the fixing device 11 when the shield member 42 is not arranged in the gap (S) is indicated by a one-dot-and-dash line.

Because the gap (S) is filled with the shield member 42, the air flowing between the tip portion 39*a* of the upper frame 39 and the circumferential surface of the rotation shaft 34*a* of the sheet guide member 34 is cut off by the shield member 42 and the steam generated in the fixing device 11 does not leak out from the fixing device 11. Accordingly, the steam does not attach to the sheet discharging device 12 positioned above the fixing device 11 in the copying machine 1.

In the above-described condition, condensation does not occur in the image forming apparatus and water droplets due to the condensation does not occur on the surface of the photoreceptor 2. Thus, the change in the photosensitive property of the photoreceptor 2 and the spread of a toner image on the surface of the photoreceptor 2 caused by the water droplets on the surface of the photoreceptor 2 are prevented. As a result, an image forming apparatus according to the present invention provides a good quality image.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A fixing device for fixing a toner image on a sheet in an image forming apparatus, comprising:

a frame;

a fusing roller rotatably provided in the frame;

a pressure roller rotatably provided in the frame and configured to press against the fusing roller;

a separating member configured to separate the sheet passed between the fusing roller and the pressure roller from the fusing roller;

a sheet guide member configured to guide the sheet separated by the separating member and rotatably supported by the frame; and a shield member configured to prevent air from flowing from a space between the frame and the sheet guide member at a position where the sheet guide member is supported by the frame.

2. The fixing device according to claim 1, wherein the shield member is provided on an upper portion of the frame.

3. The fixing device according to claim 1, wherein the shield member comprises an elastic member.

4. The fixing device according to claim 3, wherein the elastic member comprises a nonwoven fabric material.

5. The fixing device according to claim 3, wherein the elastic member comprises a foaming material.

6. The fixing device according to claim 5, wherein the foaming material has a plurality of closed-cells.

7. An image forming apparatus comprising the fixing device of claim 1.

8. The image forming apparatus according to claim 7, wherein the shield member is provided on an upper portion of the frame.

9. The image forming apparatus according to claim 7, wherein the shield member comprises an elastic member.

10. The image forming apparatus according to claim 9, wherein the elastic member comprises a nonwoven fabric material.

11. The image forming apparatus according to claim 9, wherein the elastic member comprises a foaming material.

12. The image forming apparatus according to claim 11, wherein the foaming material has a plurality of closed-cells.

13. A fixing device for fixing a toner image on a sheet in an image forming apparatus, comprising:

a frame;

fusing means for fusing a toner image on a sheet;

pressing means for pressing the sheet against the fusing means;

separating means for separating the sheet passed between the fusing means and the pressing means from the fusing means;

guiding means for guiding the sheet separated by the separating means, the guiding means being rotatably supported by the frame; and shielding means for preventing air from flowing from a space between the frame and the guiding means at a position where the guiding means is supported by the frame.

14. The fixing device according to claim 13, wherein the shielding means is provided on an upper portion of the frame.

15. The fixing device according to claim 13, wherein the shielding means comprises an elastic member.

16. The fixing device according to claim 15, wherein the elastic member comprises a nonwoven fabric material.

17. The fixing device according to claim 15, wherein the elastic member comprises a foaming material.

18. The fixing device according to claim 17, wherein the foaming material has a plurality of closed-cells.

19. A method of preventing air from flowing out from a fixing device in an image forming apparatus, the method comprising the steps of:

accommodating a fusing roller and a pressure roller in a frame of the fixing device;

providing a separating member configured to separate a sheet passed between the fusing roller and the pressure roller from the fusing roller, and a sheet guide member configured to guide the sheet separated by the separating member, the sheet guide member being rotatably supported by the frame; and providing a shield member configured to prevent air from flowing from a space between the frame and the sheet guide member at a position where the sheet guide member is supported by the frame.

20. The method according to claim 19, wherein the step of providing a shield member comprises providing the shield member on an upper portion of the frame.

* * * * *